US009608376B1

(12) United States Patent
Huang

(10) Patent No.: US 9,608,376 B1
(45) Date of Patent: Mar. 28, 2017

(54) ELECTRICAL CONNECTION DEVICE

(71) Applicants: Ying-Liang Huang, Taipei (TW); Alysium-Tech GmbH, Nuremberg (DE)

(72) Inventor: Ying-Liang Huang, Taipei (TW)

(73) Assignees: Ying-Liang Huang, Taipei (TW); ALYSIUM-TECH GMBH, Nuremberg (DE)

( * ) Notice: Subject to any disclaimer, the term of this patent is extended or adjusted under 35 U.S.C. 154(b) by 0 days.

(21) Appl. No.: 15/233,583

(22) Filed: Aug. 10, 2016

(30) Foreign Application Priority Data

Feb. 25, 2016 (CN) ..... 2016 1 0104468

(51) Int. Cl.

| | |
|---|---|
| ***H01R 13/627*** | (2006.01) |
| ***H01R 13/639*** | (2006.01) |
| ***H01R 24/64*** | (2011.01) |
| ***H01R 13/621*** | (2006.01) |
| *H01R 107/00* | (2006.01) |

(52) U.S. Cl.
CPC ..... *H01R 13/639* (2013.01); *H01R 13/6215* (2013.01); *H01R 13/6272* (2013.01); *H01R 24/64* (2013.01); *H01R 2107/00* (2013.01)

(58) Field of Classification Search
CPC ..... H01R 13/6215
USPC ..... 439/362
See application file for complete search history.

(56) References Cited

U.S. PATENT DOCUMENTS 7,479,026 B2 * 1/2009 Furusawa ..... H01R 13/502 439/362
7,749,015 B2 * 7/2010 Uchikawa ..... H01R 13/6395 439/362

* cited by examiner

*Primary Examiner* — Tho D Ta
(74) *Attorney, Agent, or Firm* — Hamre, Schumann, Mueller & Larson, P.C.

(57) ABSTRACT

An electrical connection device includes a plug connector and a positioning module. The plug connector has a plug body with first and second side surfaces respectively provided with first and second fixing holes. The positioning module includes a mounting member having a main body provided with a through hole, and a first fixing member. The through hole in the mounting member can be selectively disposed to align with the first or second fixing hole so as to fix the first fixing member in the first or second fixing hole and to connect together the positioning module and the plug connector to form a first or second assembly state of the electrical connection device.

6 Claims, 7 Drawing Sheets

ELECTRICAL CONNECTION DEVICE

CROSS REFERENCE TO RELATED APPLICATION

This application claims priority of Chinese Patent Application No. 201610104468.4, filed on Feb. 25, 2016.

FIELD

The disclosure relates to an electrical connection device, more particularly to an electrical connection device that is adjustable to change the position of a positioning structure thereof.

BACKGROUND

When a plug connector having a cable is connected to a socket connector, if the cable is accidentally pulled, it is either the plug connector is removed from the socket connector or an insert portion of the plug connector is loosened from a socket of the socket connector, so that the plug connector is unsteady and has poor electrical contact with the socket connector.

To avoid the above situation from happening, an existing method is to provide a threaded bolt on the plug connector and a corresponding threaded hole is provided in a mounting surface where the socket connector is mounted. As such, after the plug connector is connected to the socket connector, the threaded bolt is fastened to the threaded hole, and a stable connection between the plug connector and the socket connector is ensured.

Because the socket connector is disposed on different mounting surfaces, and because of the space limitation around the socket connector, the position of the threaded hole must be adjusted accordingly. Taking the socket of the socket connector being rectangular, for example, the threaded hole in one of the mounting surfaces is located on a long side of the socket, while the threaded hole in the other one of the mounting surfaces is located on a short side of the socket. Since the threaded bolt of the plug connector is disposed on a fixed location, it is applicable to be connected only to the threaded hole located either in the long side or the short side of the socket connector, but not for both sides.

SUMMARY

Therefore, an object of the present disclosure is to provide an electrical connection device that is adjustable to change the position of a positioning structure thereof.

Accordingly, an electrical connection device comprises a plug connector and a positioning module. The plug connector has a plug body and an insertion portion projecting outwardly from the plug body and having a rectangular cross section. The plug body has a first side surface parallel to one of two long sides of the insertion portion, and a second side surface parallel to one of two short sides of the insertion portion. The first side surface is provided with a first fixing hole. The second side surface is provided with a second fixing hole. The positioning module includes a mounting member, a first fixing member and two second fixing members. The mounting member has a main body and two positioning structures connected to the main body. The main body is provided with a through hole for extension of the first fixing member therethrough. Each of the positioning structures has an abutment surface parallel to an end surface of the insertion portion which is distal from the plug body.

The second fixing members are respectively disposed on the positioning structures. Each of the second fixing members has a connecting portion protruding from the abutment surface of a respective one of the positioning structures.

The through hole in the mounting member can be selectively disposed to align with the first fixing hole so as to fix the first fixing member in the first fixing hole and to connect together the positioning module and the plug connector to form a first assembly state of the electrical connection device, or to align with the second fixing hole so as to fix the first fixing member in the second fixing hole and to connect together the positioning module and the plug connector to form a second assembly state of the electrical connection device.

The positioning structures and the second fixing members are located proximate to the short sides of the insertion portion in the first assembly state, and are located proximate to the long sides of the insertion portion in the second assembly state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
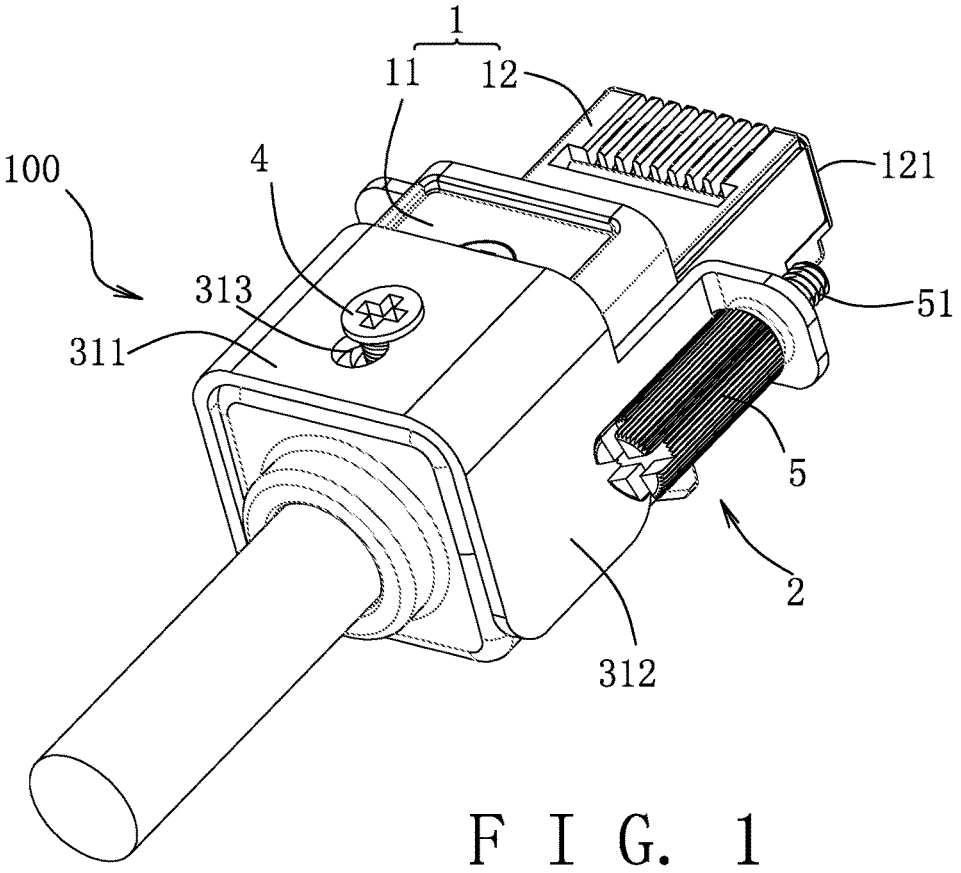
FIG. 1 is a perspective view of a first assembly state of an electrical connection device according to the embodiment of the present disclosure.

Referring to FIGS. 1 to 7, an electrical connection device 100 according to the embodiment of the present disclosure is shown to comprise a plug connector 1 and a positioning module 2.

The plug connector 1 is configured to connect with a socket connector (not shown), and has a plug body 11, and an insertion portion 12 projecting outwardly from the plug body 11 and having a rectangular cross section. The plug body 11 has a first side surface 111 parallel to one of two long sides of the insertion portion 12, and a second side surface 112 parallel to one of two short sides of the insertion portion 12. The first side surface 111 is provided with a first fixing hole 113, while the second side surface 112 is provided with a second fixing hole 114. In this embodiment, the plug body 11 has a square cross section, but may also have a rectangular cross section. The cross section of the plug body 11 is not limited to what is disclosed herein.

Figure 6:
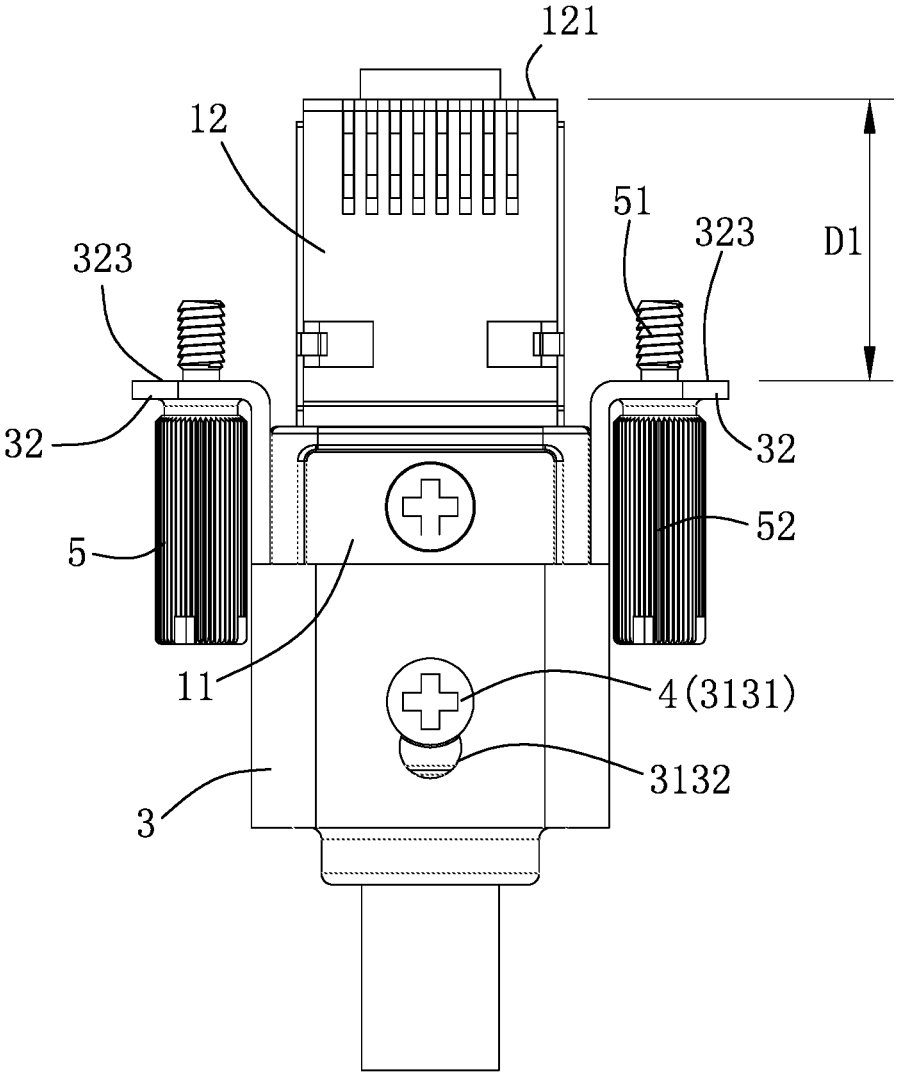
FIG. 6 is a top view of the embodiment, illustrating a first fixing member of the positioning module disposed in a first hole portion of the mounting member.

The positioning module 2 includes a mounting member 3, a first fixing member 4 and two second fixing members 5. The mounting member 3 has a main body 31 and two positioning structures 32 connected to the main body 31. The main body 31 has a main plate portion 311 and two side plate portions 312 respectively connected to two opposite sides of the main plate portion 311. The main plate portion 311 is provided with a through hole 313 for extension of the first fixing member 4 therethrough. The positioning structures 32 are respectively connected to the side plate portions 312. In this embodiment, each of the positioning structures 32 has a connecting plate portion 321 extending outwardly from a respective one of the side plate portions 312, and a fixing plate portion 322 extending transversely from one end of the connecting plate portion 321, which is opposite to the respective side plate portion 312, in a direction away from the other one of the positioning structures 32. The fixing plate portion 322 has an abutment surface 323, and a positioning hole 324 for extension of one of the second fixing members 5 therethrough. As shown in FIG. 6, the abutment surfaces 323 of the fixing plate portions 322 of the positioning structures 32 are parallel to an end surface 121 of the insertion portion 12 which is distal from the plug body 11.

The second fixing members 5 are respectively disposed on the positioning structures 32. Each of the second fixing members 5 has a connecting portion 51 protruding from the abutment surface 323 of a respective one of the positioning structures 32. In this embodiment, the first fixing member 4 is a screw, and each of the first and second fixing holes 113, 114 is a threaded hole for engagement with the screw. Through this, the first fixing member 4 can be detachably connected to the plug body 11 of the plug connector 1. Further, each second fixing member 5 of this embodiment is also a screw, but of another type, which is rotatably disposed on and which cannot be separated from the respective fixing plate portion 322. Each second fixing member 5 further has a force-receiving portion 52 connected to the connecting portion 51 and opposite to the abutment surface 323 for a user to apply a rotational force thereto. The connecting portions 51 of the second fixing members are configured to connect with threaded holes (not shown) in a mounting surface where the socket connector is disposed. The first and second fixing members 4, 5 are not limited to screws, and may be other detachable fixing structures, for example, snap fit connection. The structure of each of the first and second fixing holes 113, 114 is adjusted to match that of the first fixing member 4, and the structure of each second fixing member 5 and the mounting surface, where the socket connector is disposed, are together adjusted to match each other.

Figure 2:
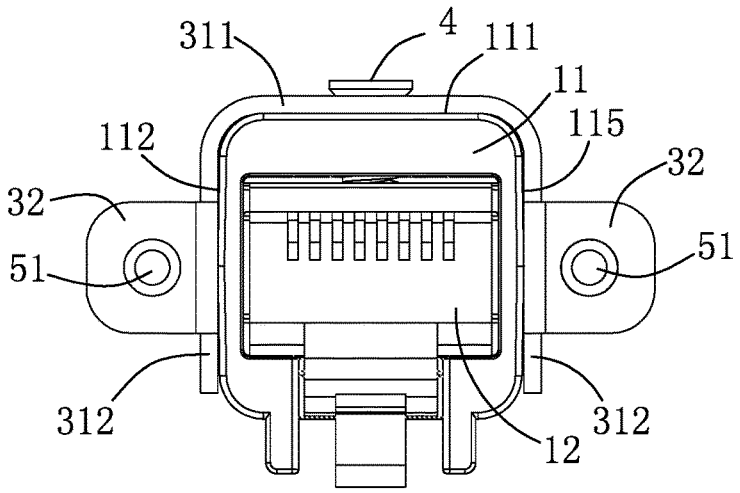
FIG. 2 is a front view of the first assembly state of the embodiment.
Figure 3:
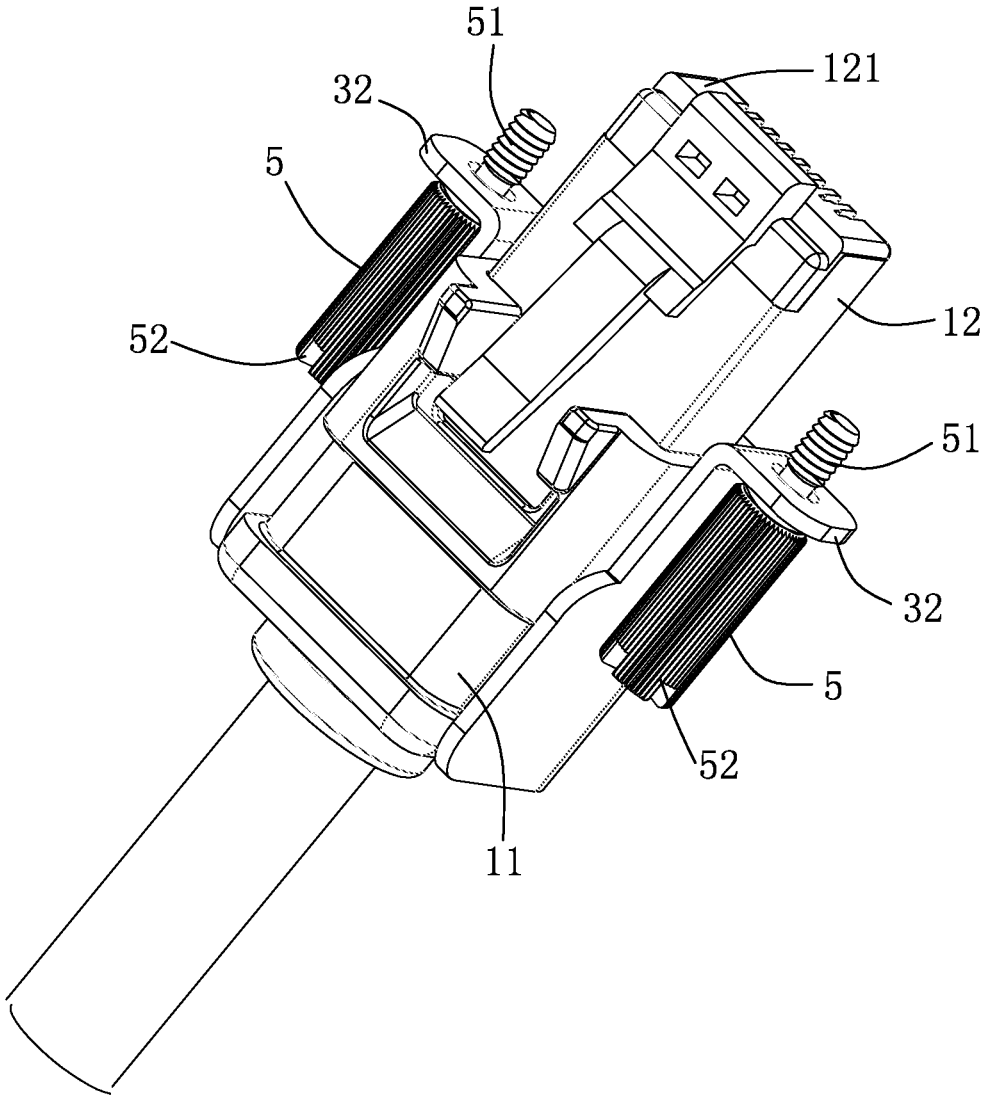
FIG. 3 is another perspective view of the first assembly state of the embodiment taken from another angle.
Figure 4:
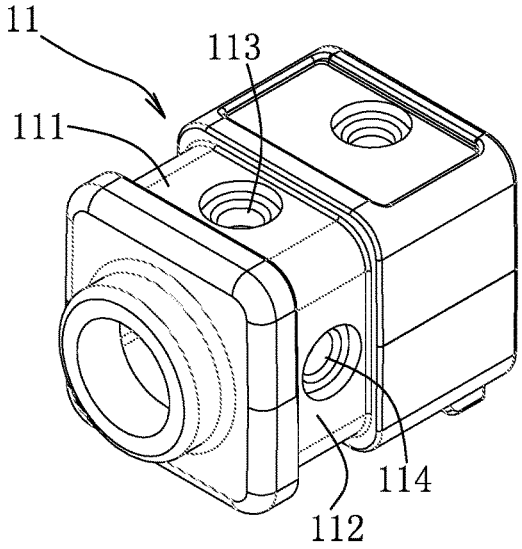
FIG. 4 is a perspective view of a plug body of a plug connector of the embodiment.
Figure 8:
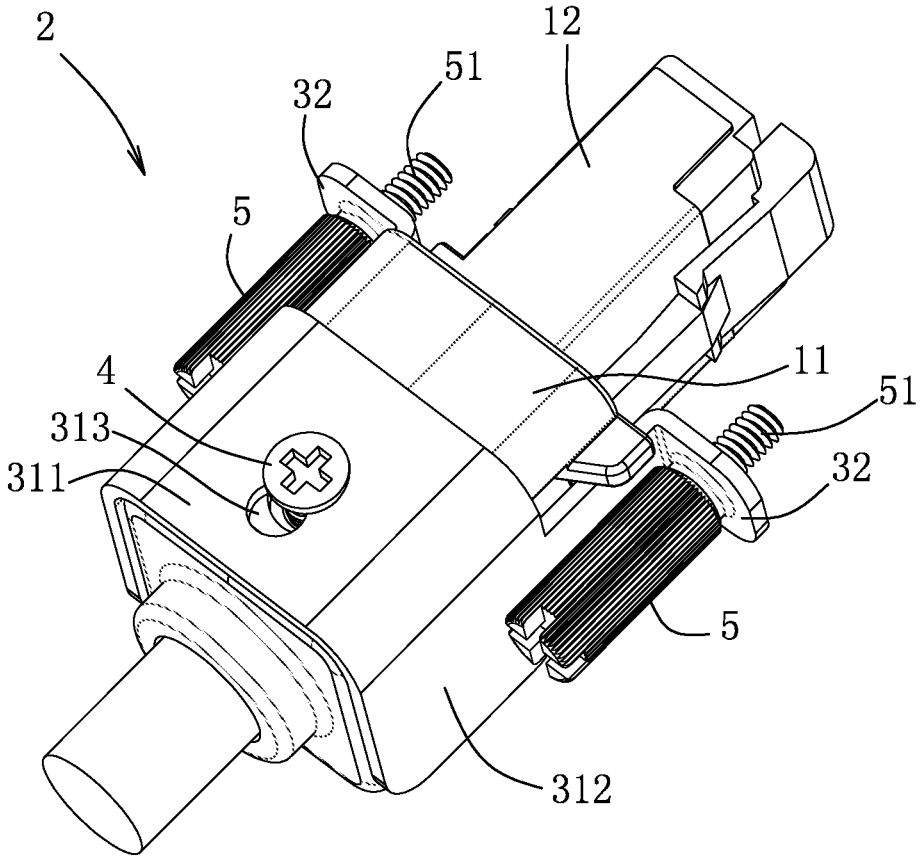
FIG. 8 is a perspective view of a second assembly state of the embodiment.
Figure 9:
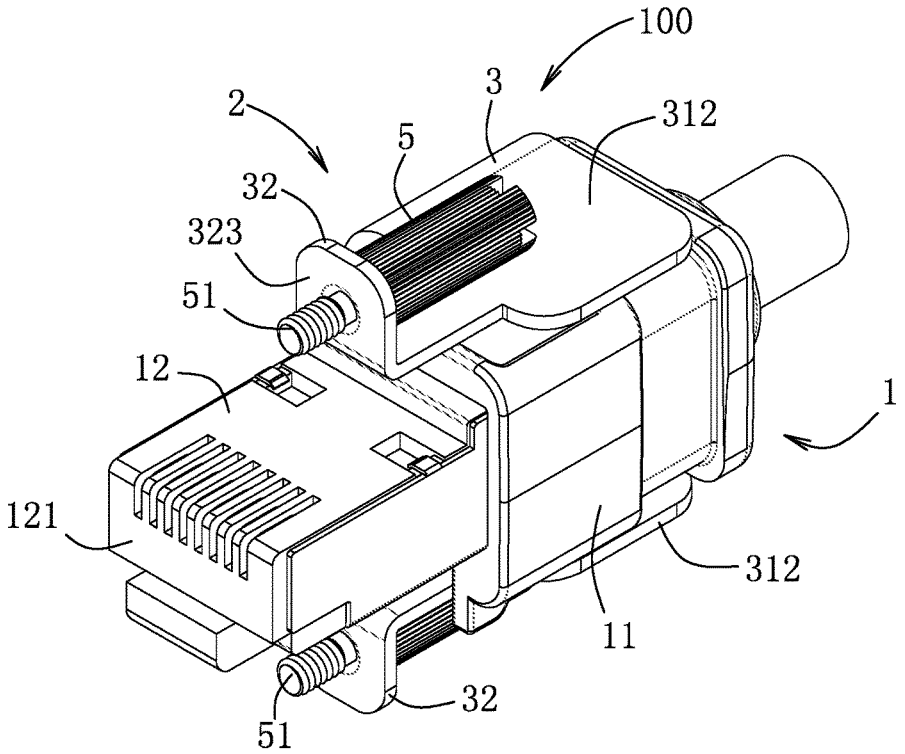
FIG. 9 is another perspective view of the second assembly state of the embodiment taken from another angle.
Figure 10:
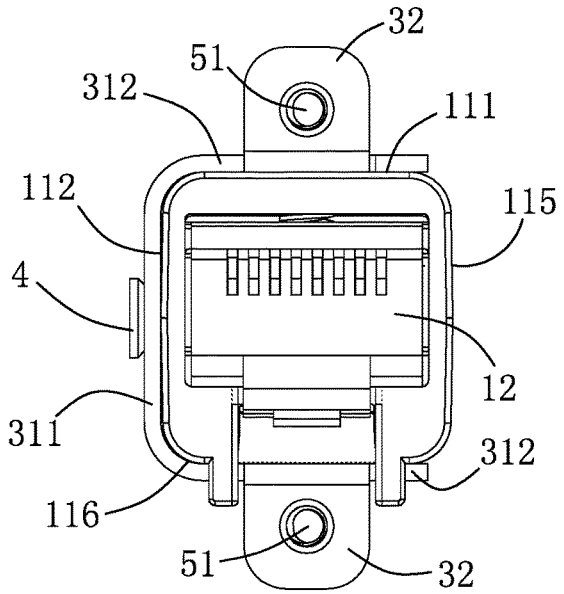
FIG. 10 is a front view of the second assembly state of the embodiment.

The through hole 313 in the mounting member 3 can be selectively disposed to align with the first fixing hole 113 so as to fix the first fixing member 4 in the first fixing hole 113 and connect together the positioning module 2 and the plug connector 1 to form a first assembly state, as shown in FIGS. 1 to 3, or to align with the second fixing hole 114 so as to fix the first fixing member 4 in the second fixing hole 114 and connect together the positioning module 2 and the plug connector 1 to form a second assembly state, as shown in FIGS. 8 to 10.

With reference to FIGS. 1 to 3, in the first assembly state, the main body 31 of the mounting member 3 covers the plug body 11 of the plug connector 1 with the main plate portion 311 abutting against the first side surface 111 of the plug body 11 and the side plate portions 312 respectively abutting against the second side surface 112 and a third side surface 115 of the plug body 11. The third side surface 115 is opposite to the second side surface 112. Further, the positioning structures 32 and the second fixing members 5 are located proximate to the short sides of the insertion portion 12. As such, when the plug connector 1 is connected to the socket connector, the connecting portions 51 of the second fixing members 5 can respectively engage with the threaded holes in the mounting surface. In this state, the threaded holes in the mounting surface are located on two short sides of the socket connector.

With reference to FIGS. 8 to 10, in the second assembly state, the main body 31 of the mounting member 3 covers the plug body 11 of the plug connector 1 with the main plate portion 311 abutting against the second side surface 112 of the plug body 11 and the side plate portions 312 respectively abutting against the first side surface 111 and a fourth side surface 116 of the plug body 11. The fourth side surface 116 is opposite to the first side surface 111. Further, the positioning structures 32 and the second fixing members 5 are located proximate to the long sides of the insertion portion 12. As such, when the plug connector 1 is connected to the socket connector, the connecting portions 51 of the second fixing members 5 can respectively engage with the threaded holes in the mounting surface. In this state, the threaded holes in the mounting surface are located on two long sides of the socket connector.

In other words, the assembly state of the positioning module 2 and the plug connector 1 can be adjusted according to the position of the threaded holes in the mounting surface where the socket connector is disposed, so that the position of the positioning structure 32 can be flexibly adjusted.

Furthermore, in this embodiment, the cross section of the plug body 11 is a square, and the side plate portions 312 of the mounting member 3 are supported by the plug body 11 in the first and second assembly states. If the cross section of the plug body 11 is a rectangle, a frame-shaped gasket (not shown) may be sleeved on the plug body 11 for abutment of the two side plate portions 312 therewith. However, it may also be implemented even without the gasket.

Figure 5:
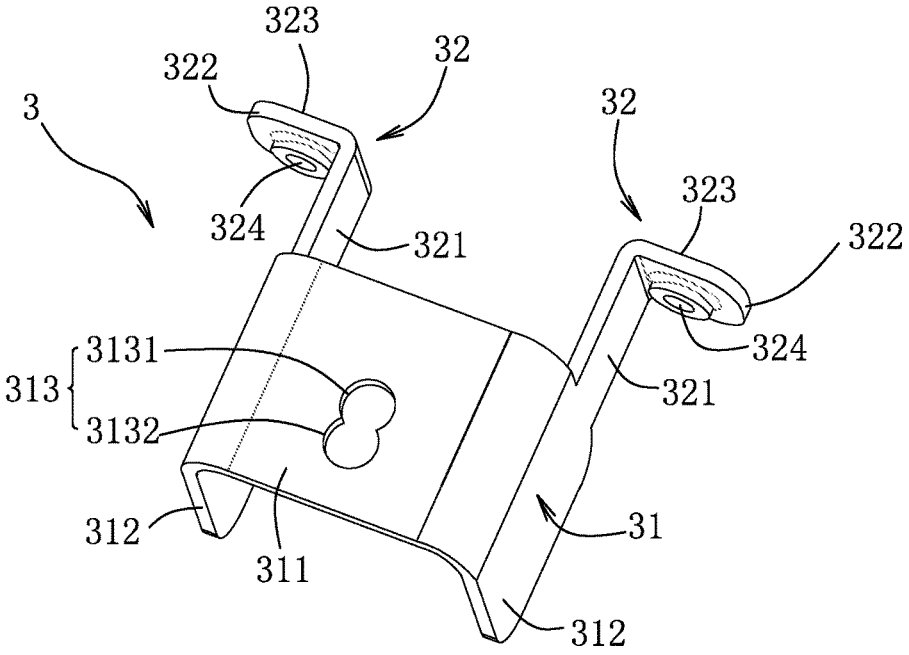
FIG. 5 is a perspective view of a mounting member of a positioning module of the embodiment.
Figure 7:
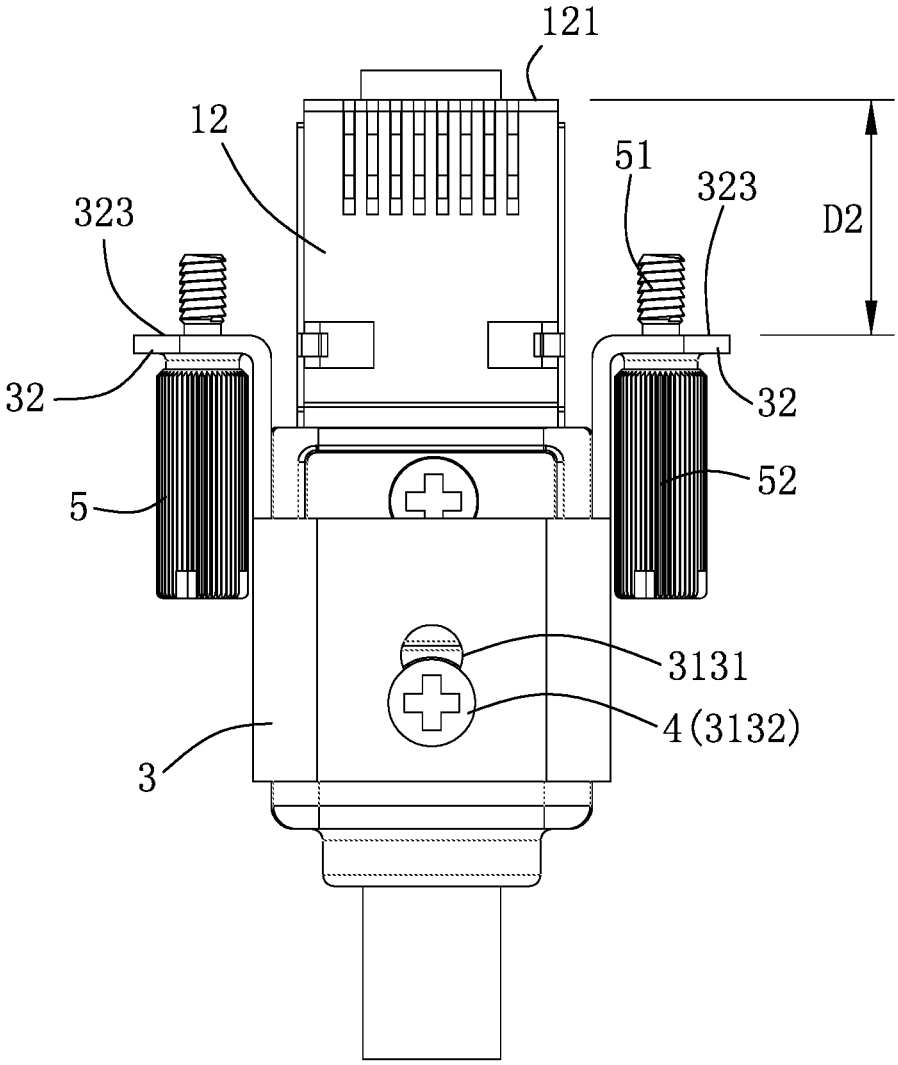
FIG. 7 is a view similar to FIG. 6, but illustrating the first fixing member of the positioning module disposed in a second hole portion of the mounting member.

With reference to FIGS. 5 to 7, the through hole 313 in the mounting member 3 has a first hole portion 3131 and a second hole portion 3132 communicating with each other. The first fixing member 4 is selectively positioned between the first and second hole portions 3131, 3132 to adjust the distance between the abutment surface 323 of each positioning structure 32 and the end surface 121 of the insertion portion 12. As shown in FIGS. 6 and 7, the distance (D1) between the abutment surface 323 and the end surface 121 of the insertion portion 12 when the first fixing member 4 is positioned in the first hole portion 3131 is greater than the distance (D2) between the abutment surface 323 and the end surface 121 of the insertion portion 12 when the first fixing member 4 is positioned in the second hole portion 3132. Based on the same principle, in the second assembly state, the components may also be adjusted as such. Through this, the electrical connection device 100 can be connected with socket connector having insertion holes of different depths.

In sum, the electrical connection device 100 of this embodiment has two assembly states, so that the position of the positioning structures 32 can be flexibly adjusted according to the structure of the mounting surface, where the socket connector is disposed, and so that the plug connector 1 can be smoothly and stably connected to the socket connector. Hence, the object of this disclosure can be realized.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrical connection device comprising:

a plug connector having a plug body and an insertion portion projecting outwardly from said plug body and having a rectangular cross section, said plug body having a first side surface parallel to one of two long sides of said insertion portion, and a second side surface parallel to one of two short sides of said insertion portion, said first side surface being provided with a first fixing hole, said second side surface being provided with a second fixing hole; and a positioning module including a mounting member, a first fixing member and two second fixing members, said mounting member having a main body and two positioning structures connected to said main body, said main body being provided with a through hole for extension of said first fixing member therethrough, each of said positioning structures having an abutment surface parallel to an end surface of said insertion portion which is distal from said plug body, said second fixing members being respectively disposed on said positioning structures, each of said second fixing members having a connecting portion protruding from said abutment surface of a respective one of said positioning structures;

wherein, said through hole in said mounting member can be selectively disposed to align with said first fixing hole so as to fix said first fixing member in said first fixing hole and to connect together said positioning module and said plug connector to form a first assembly state of said electrical connection device, or to align with said second fixing hole so as to fix said first fixing member in said second fixing hole and to connect together said positioning module and said plug connector to form a second assembly state of said electrical connection device; and wherein said positioning structures and said second fixing members are located proximate to said short sides of said insertion portion in the first assembly state, and are located proximate to said long sides of said insertion portion in the second assembly state.

2. The electrical connection device as claimed in claim 1, wherein said through hole in said mounting member has a first hole portion and a second hole portion communicating with each other, and said first fixing member is selectively positioned between said first and second hole portions to adjust the distance between said abutment surface of each of said positioning structures and said end surface of said insertion portion.

3. The electrical connection device as claimed in claim 1, wherein said main body of said mounting member has a main plate portion and two side plate portions respectively connected to two opposite sides of said main plate portion, said main plate portion being provided with said through hole, said positioning structures being respectively connected to said side plate portions.

4. The electrical connection device as claimed in claim 3, wherein each of said positioning structures has a connecting plate portion extending outwardly from a respective one of said side plate portions, and a fixing plate portion extending transversely from one end of said connecting plate portion, which is opposite to the respective one of said side plate portions, in a direction away from the other one of said positioning structures, said fixing plate portion having said abutment surface, and a positioning hole for extension of one of said second fixing members therethrough.

5. The electrical connection device as claimed in claim 3, wherein said plug body further has a third side surface opposite to said second side surface, and wherein, in the first assembly state, said main body of said mounting member covers said plug body of said plug connector with said main plate portion abutting against said first side surface and said side plate portions respectively abutting against said second and third side surfaces of said plug body.

6. The electrical connection device as claimed in claim 5, wherein said plug body has a square cross section and further has a fourth side surface opposite to said first side surface, and wherein, in the second assembly state, said main body of said mounting member covers said plug body of said plug connector with said main plate portion abutting against said second side surface and said side plate portions respectively abutting against said first and fourth side surfaces of said plug body.

* * * * *